United States Patent [19]

Perri

[11] 4,244,552

[45] Jan. 13, 1981

[54] CORNER WEDGING CONSUMABLE HOT TOP

[75] Inventor: Joseph A. Perri, Corapolis, Pa.

[73] Assignee: Insul Company, Inc., East Palestine, Ohio

[21] Appl. No.: 77,169

[22] Filed: Sep. 20, 1979

[51] Int. Cl.[3] ..... B22D 7/10

[52] U.S. Cl. ..... 249/197; 249/202

[58] Field of Search ..... 249/197-202, 249/106

[56] References Cited

U.S. PATENT DOCUMENTS

| | | | |
|---|---|---|---|
| 2,822,591 | 2/1958 | Hampe | 249/106 |
| 3,039,158 | 6/1962 | Mueller | 249/201 X |
| 3,165,798 | 1/1965 | LaBate | 249/198 X |
| 3,391,896 | 7/1968 | Lobstein et al. | 249/106 |
| 3,478,999 | 11/1969 | Charman, Jr. et al. | 249/201 |
| 3,797,801 | 3/1974 | Mueller | 249/197 |
| 4,121,805 | 10/1978 | LaBate | 249/197 |

FOREIGN PATENT DOCUMENTS

| | | | |
|---|---|---|---|
| 525428 | 5/1956 | Canada | 249/201 |

*Primary Examiner*—R. L. Spruill
*Assistant Examiner*—J. Reed Batten, Jr.
*Attorney, Agent, or Firm*—Webster B. Harpman

[57] ABSTRACT

A corner wedging consumable hot top for ingot molds is formed of four side board sections and four corner wedges made of a combustible consumable material capable of being wedged in opposed relation within an ingot mold so that the hot top formed thereby conforms with the cavity shape in the ingot mold and when ignited by the molten metal poured therein supplies heat to maintain a pool of molten metal as necessary for filling cracks and pipes in the cooling ingot.

5 Claims, 6 Drawing Figures

CORNER WEDGING CONSUMABLE HOT TOP

BACKGROUND OF THE INVENTION

1. Field of the Invention:

This invention relates to consumable hot tops as positioned in the upper ends of ingot molds for maintaining a pool of molten melt in desirable position in the cooling ingot.

2. Description of the Prior Art:

Prior art hot top constructions have comprised a variety of devices for the intended purpose. Several of these have used wedges to position the side board sections of the hot top in the ingot mold. See for example U.S. Pat. No. 3,797,801 in which a pair of corner post devices are used to cooperate with the foldable wall sections to produce a hot top enclosure.

In U.S. Pat. No. 4,121,805 a self adjusting consumable hot top includes shape adjusting sections and wedges for securing them in wedged position in an ingot mold.

Still other forms of hot tops may be seen in U.S. Pat. No. 3,478,999 wherein the corner portions of the hot top space the side board panels and U.S. Pat. No. 3,165,798 wherein the consumable hot top is formed of interengaging portions which are moved into desired relation by tapered wedges inserted at the corners.

In the present disclosure side board sections of a consumable hot top are formed with novel end configurations designed to receive and be wedged by novel corner pieces, both of which end sections of the side boards and the corner pieces can be formed with relatively simple dies.

In the prior art, in constructions generally used, the corner pieces or wedges, such as seen for example in U.S. Pat. No. 3,797,801, have their vertical sides or contact surfaces at an angle greater than 90° to the inner surface thereof. Such corner pieces or wedges are difficult to form of consumable material because their shape prohibits their ready removal from a die cavity in which they are formed unless a multi-part die is used and operated to permit the formed product to be released. Of equal importance is the inherent problem in installing the heretofore conventional corner pieces or wedges between the side boards in positioning a consumable hot top in an ingot mold. The mold itself is tapered and often of irregular inner configuration. The corner pieces or wedges therefore loosely engage the edges of the ends of the side boards and are not easily retained in the desired position during the simultaneous positioning of the side boards and the corner pieces in the open upper end of the ingot mold. With the invention disclosed herein, the abutting ends of the side boards are formed with configurations which tend to confine or limit movement of the corner pieces or wedges and prevent their accidental dislocation from the desired areas during installation. The corner pieces or wedges as disclosed herein are formed with their longitudinal side edges at less than 90° to their inner surfaces and are thereby self-retaining in the desired location. Additionally, yieldable metal holders, such as sections of wire, positioned transversely of the corner pieces, serve to increase the initial frictional engagement of the corner pieces or wedges against the vertical tapered edges of the side boards of the hot top.

None of these advantages are found in the prior art constructions.

SUMMARY OF THE INVENTION

A corner wedging consumable hot top is formed of four side boards or panels, the vertical ends or edges of which are tapered and shaped with angular configurations which confine four corner pieces in wedging relation to the side boards. The side boards or panels and the corner pieces are formed of suitable consumable material and the arrangement enables the relatively quick and easy installation of the panels and wedges in the open upper end of an ingot mold in satisfactory wedging position so as to retain the hot top in the ingot mold during a subsequent pouring of hot metal therein.

DESCRIPTION OF THE PREFERRED EMBODIMENT

Figure 1:
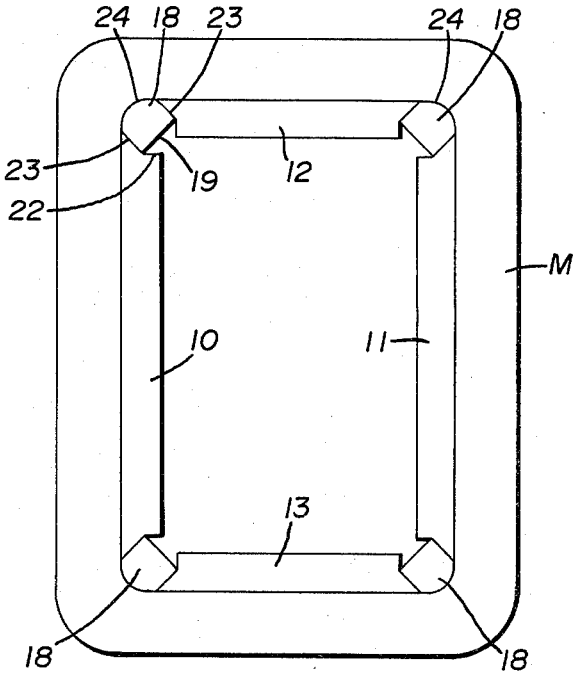
FIG. 1 is a top plan view of a hot top as disclosed herein positioned in an ingot mold.

By referring to the drawings and FIG. 1 in particular, it will be seen that the top end of an ingot mold is indicated by the letter M and a consumable hot top is disposed therein and is formed of four side boards arranged in oppositely disposed elongated side sections 10 and 11 and oppositely disposed elongated end sections 12 and 13. Each of the side boards 10, 11, 12, and 13 is narrower at its upper end than at its lower end as may be seen in FIG. 3 of the drawings, wherein a plan view of one of the side boards 10 may be seen.

Figure 3:
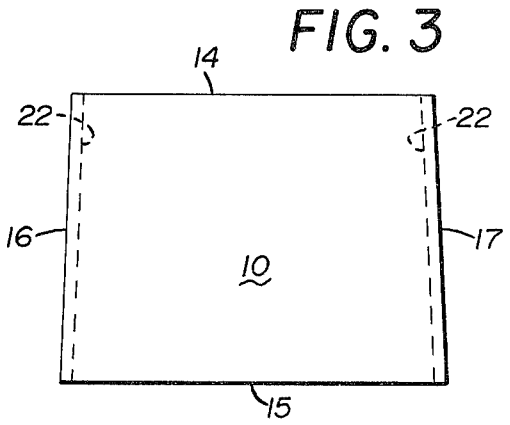
FIG. 3 is a plan view of one of the side boards of the hot top seen in FIG. 1 of the drawings.

In FIG. 3 of the drawings, the upper end or edge of the side board 10 is indicated by the numeral 14 and its lower edge by the numeral 15 and its vertical ends by the numerals 16 and 17 respectively. Each of the side boards 10, 11, 12 and 13 are similarly formed so that as positioned in the ingot mold M, they will be wedgingly held in position by four wedged-shaped corner pieces 18, each of which may be seen in top plan view in FIG. 1 and in perspective view in FIG. 2 and in end elevation in FIG. 4. Each of the identically formed corner pieces 18 has an inner vertical surface 19 and right angular related side tapering surfaces 20 and 21, the arrangement being such that the corner pieces 18 are larger at their upper ends than at their lower ends so that they may be pushed downwardly between the ends of the side boards 10, 11, 12, and 13 as shown in FIG. 1 of the drawings where they will hold the same in assembled relation to form an effective consumable hot top in the open upper end of the ingot mold M.

Figure 2:
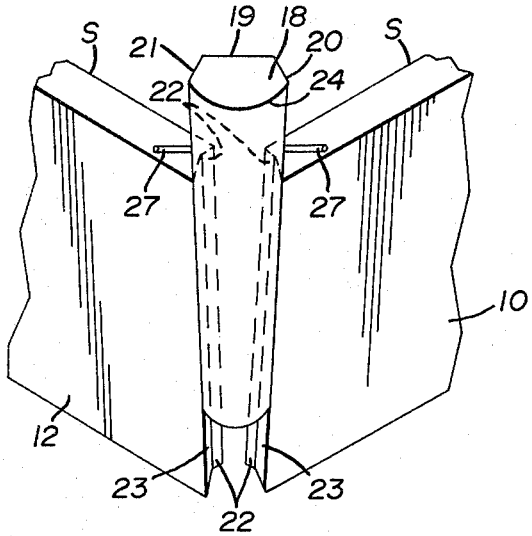
FIG. 2 is a perspective view of the corner portions of two of the side boards and one of the corner pieces, with parts broken away, as seen in FIG. 1 of the drawings.

By referring to FIGS. 1 and 2 of the drawings, it will be seen that the vertical ends of each of the side boards 10, 11, 12 and 13 have angular configuration along their tapered surfaces and each side board has a right angular edge portion 22 on each of its ends extending inwardly of its inner flat inner side surface S along with an outwardly 45° angled surface 23 on each of its vertical tapered ends.

Still referring to FIGS. 1 and 2 of the drawings, it will be seen that when the corner pieces 18 are positioned in the corners of the ingot mold 10 and between the tapered generally vertically ends of the side boards 10, 11, 12 and 13, they will present an outer curved surface 24 to the corners of the ingot mold so that molten metal will not be able to enter the corner areas of the ingot mold around the hot top and chill therein as has been common in the art heretofore. The wedging action is also improved by the configuration of the corner pieces 18 so that the hot top formed therewith will not float on the molten metal poured in the ingot mold as will be understood by those skilled in the art.

Figure 4:
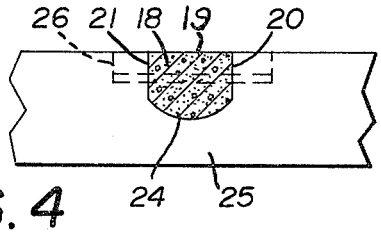
FIG. 4 is an end elevation of one of the corner pieces or wedges showing the same in the die in which it is formed.

In FIG. 4 of the drawings, a portion of a die 25 may be seen and one of a number of cavities is formed therein in which the corner pieces 18 may be formed by filling the die cavity with a suitable consumable mixture.

In FIG. 4 it will be seen that the oppositely disposed side surfaces 20 and 21 of the corner piece are vertical and that the outermost portion of the corner piece which is curved as at 24 matches the curved configuration of the die cavity. Transverse slots 26 in the die and crossing each of the plurality of cavities therein provide for the positioning of a piece of wire or similar metal which becomes part of the corner piece 18 with the ends of the wire extending outwardly of the sides thereof as indicated at 27 in FIG. 2 of the drawings where the wire support the corner pieces 18 with respect to the side boards during the initial positioning and installation and then distort and form friction holding members when the corner pieces 18 are pushed downwardly between the ends of the four side boards of each of the hot tops as herein disclosed.

Figure 5:
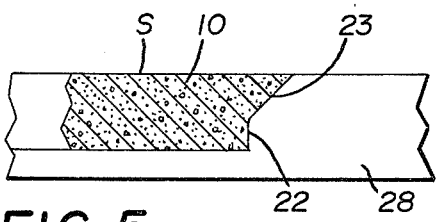
FIG. 5 is an end elevation of a portion of one of the side boards of the hot top showing the same in the die in which it is formed.

In FIG. 5 of the drawings, a portion of a die 28 may be seen with a cavity partially illustrated therein in which the side boards 10, 11, 12 and 13 are formed by filling the cavities with a suitable mixture of consumable materials as will be understood by those skilled in the art. The configuration of each of the cavities in the die 28 forms the end configurations of the side boards 10, 11, 12 and 13 as hereinbefore described.

By referring again to FIG. 1 of the drawings, it will be seen that when the assembled hot top is positioned in the ingot mold M, the inner corners of each of the side boards 10, 11, 12, and 13 extend inwardly of and in front of the squared corners of the tapered sides of the corner pieces 18. Thus in effect the corner pieces are overlapped partially by the inner corners of the side boards 10, 11, 12 and 13 and they cannot therefore fall inwardly into the cavity in the ingot mold M as may otherwise occur when the hot top assembly is being installed. A further additional advantage of the construction disclosed herein is the inherent ability of the corner pieces 18 in their wedging relation to the side boards 10, 11, 12 and 13, to exert wedging force against the actual rounded corners of the ingot mold M as well as against the angular surface 23 on the ends of the side boards 10, 11, 12 and 13 and against the corners formed between the angular surface 23 and the right angular end portions 22 of each of the side boards 10, 11, 12 and 13.

Referring again to FIG. 4 of the drawings, it will be obvious to those skilled in the art that the near vertical walls of the cavity illustrated therein actually incline outwardly to provide the necessary drift so that the corner pieces formed therein can be removed therefrom.

Thus the opposite side surfaces 20 and 21 of the corner pieces 18 are at angles of less than 90° to the surface 19 thereof. This shape contributes to the engagement of the corners of the corner pieces 18 against the end portions 22 of the side boards 10, 11, 12, and 13 respectively.

Figure 6:
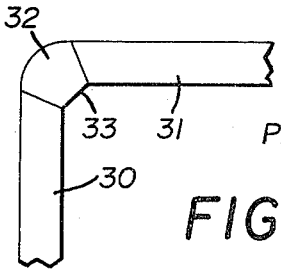
PRIOR ART FIG. 6
FIG. 6 is a top plan view of a corner of a prior art hot top.

By referring now to FIG. 6 of the drawings, a typical prior art hot top construction may be seen and it will be observed that the side boards as indicated at 30 and 31 are engaged by a corner piece 32 and that the ends of the side boards 30 and 31 are angularly disposed with respect to the inner surface thereof and the vertical sides of the corner pieces 32 are formed at similar angles so that the innermost surface 33 of the corner piece is substantially narrower than the outermost surface thereof which is curved.

It will be obvious that the corner piece 32 cannot be formed in a die and that when it is formed and positioned as shown in FIG. 6, looseness in the assembly permits the corner piece 32 to fall inwardly and/or downwardly of the ingot mold in which the hot top is being installed.

The present invention therefore resides in two substantial improvements in the art, the first of these being the shaping of the corner pieces 18 with their inner corner surfaces being at least as wide and preferably wider than their outer surfaces which are curved and engage the ingot mold and with their respective side portions arranged at less than 90° to the inner surfaces 19 as herein disclosed.

The second important improvements is in the configuration of the tapered ends of the side board sections used in forming the hot top and wherein each of their ends have right angular end portions extending from their inner surfaces and angular outward extensions therefrom so as to form vertically positioned corners for the retention and location and engagement of the corner pieces 18.

In summary, the four corner pieces and four hot top side boards disclosed herein are so formed as to advantageously create a hot top when assembled in an ingot mold and of equal importance they are so formed that they can be quickly and inexpensively formed in appropriately shaped die cavities and easily removed therefrom after baking. The corner pieces and hot top sections hereinbefore disclosed have been referred to as being formed of consumable and those in the art will appreciate that this can comprise consumable material such as set forth in LaBate U.S. Pat. No. 4,121,805, and specifically a compound consistng of about 15% wood fiber, about 54% dolomite and about 31% sodium silicate. Alternately the corner pieces 18 and the side boards 10, 11, 12 and 13 may be formed of a compound consisting of about 15% wood fiber of paper pulp, about 54% dolomite and about 3% sodium silicate together with a known amount of an exothermic reactive material such as thermite.

Although but one embodiment of the present invention has been illustrated and described, it will be apparent to those skilled in the art that various changes and modifications may be made therein without departing from the spirit of the invention and having thus described my invention what I claim is:

1. A consumable hot top for installation in the upper end of an ingot mold and comprising four solid preshaped sections of consumable disintegratable material and four corner pieces arranged in a walled structure having open upper and lower ends, each of said preshaped sections having an outer surface and an inner surface, the ends of said preshaped sections each being formed with first end portions extending at right angles from said inner surface and second end portions extending outwardly from said first end portions at 45° angles with said outer surface, so that the second end portions increase the width of said preshaped sections, said corner pieces each having flat inner surfaces and oppositely disposed sides disposed at about 90° angles thereto, with the outer surfaces of said corner pieces opposite said inner surfaces being outwardly curved, said ends of said preshaped sections being downwardly outwardly tapered and said corner pieces being oppositely tapered so as to engage said preshaped sections in a wedging action expanding the over all size of the wall structure when moved between said preshaped sections.

2. The consumable hot top of claim 1 wherein the corner pieces as assembled are of a thickness whereby their inner surfaces are disposed at the intersection of the first and second end portions of said preshaped sections.

3. The consumable hot top of claim 1 wherein the configurations of said corner pieces and said preshaped sections are of a greater area adjacent their surfaces defining the outer surfaces of the wall structure than their inner surfaces whereby said corner pieces and said preshaped sections may be formed in dies with fixed cavities for easy removal therefrom.

4. The consumable hot top of claim 1 wherein said inner surfaces of said preshaped sections are smaller in length than their outer surfaces.

5. The consumable hot top of claim 1 wherein said inner surfaces of said preshaped sections are of a predetermined length and the outer surfaces of said preshaped sections are of a predetermined length greater than that of said inner surfaces with the ends of said preshaped sections spaced at the corners of the walled structure and the corner pieces disposed in said corners and said corner pieces being of a width less than the space between said inner surfaces of said preshaped sections so as to be caged thereby.

* * * * *